United States Patent [19]

Peterson

[11] 4,031,974

[45] June 28, 1977

[54] BORING APPARATUS CAPABLE OF BORING STRAIGHT HOLES

[75] Inventor: Carl R. Peterson, Boxford, Mass.

[73] Assignee: Rapidex, Inc., Gloucester, Mass.

[22] Filed: May 27, 1975

[21] Appl. No.: 581,379

[52] U.S. Cl. ..... 175/334; 175/391; 175/344

[51] Int. Cl.[2] ..... E21B 9/24

[58] Field of Search ..... 175/344–347, 175/334, 335, 61, 73, 76, 53, 325, 406, 340, 339, 391

[56] References Cited

UNITED STATES PATENTS

| | | | |
|---|---|---|---|
| 1,302,058 | 4/1919 | Layne | 175/345 X |
| 1,391,626 | 9/1921 | Gilthorpe | 175/98 |
| 1,864,274 | 6/1932 | Santiago | 175/345 X |
| 2,122,863 | 7/1938 | Howard et al. | 175/335 X |
| 3,231,033 | 1/1966 | Williams, Jr. | 175/344 X |
| 3,237,705 | 3/1966 | Williams, Jr. | 175/406 |

*Primary Examiner*—Ernest R. Purser
*Assistant Examiner*—Richard E. Favreau

[57] ABSTRACT

A rock boring assembly for producing a straight hole for use in a drill string above a pilot boring bit of predetermined diameter smaller than the desired final hole size. The boring assembly comprises a small conical boring bit and a larger conical boring bit, the conical boring bits mounted on lower and upper ends of an elongated spacer, respectively, and the major effective cutting diameters of each of the conical boring bits being at least 10% greater than the minor effective cutting diameter of the respective bit. The spacer has a cross-section resistant to bending and spaces the conical boring bits apart a distance at least 5 times the major cutting diameter of the small conical boring bit, thereby spacing the pivot points provided by the two conical boring bits to limit bodily angular deflection of the assembly and providing a substantial moment arm to resist lateral forces applied to the assembly by the pilot bit and drill string. The spacing between the conical bits is less than about 20 times the major cutting diameter of the lower conical boring bit to enable the spacer to act as a bend-resistant beam to resist angular deflection of the axis of either of the conical boring bits relative to the other when it receives uneven lateral force due to non-uniformity of cutting conditions about the circumference of the bit. Advantageously the boring bits also are self-advancing and feature skewed rollers.

7 Claims, 9 Drawing Figures

FIG 1
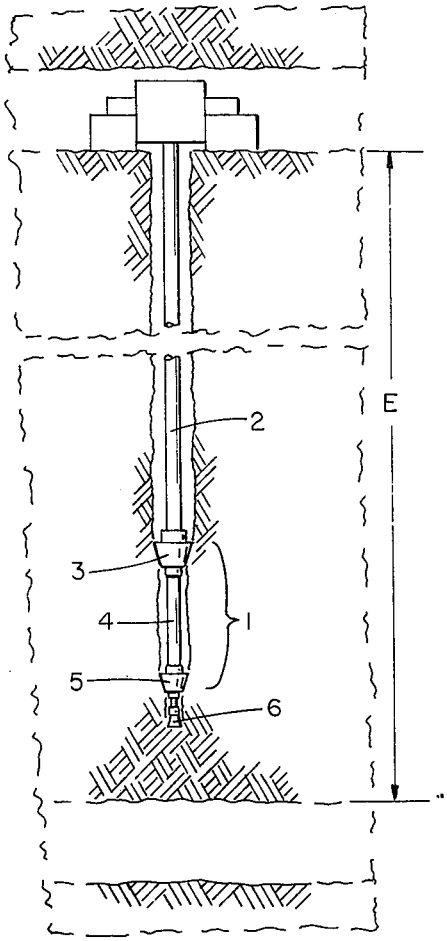
FIG 2
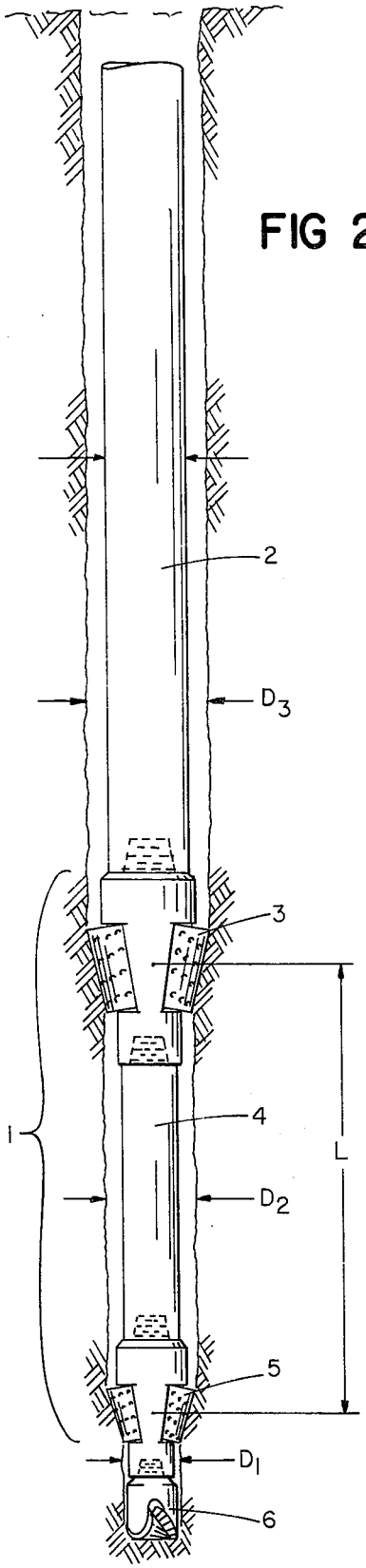
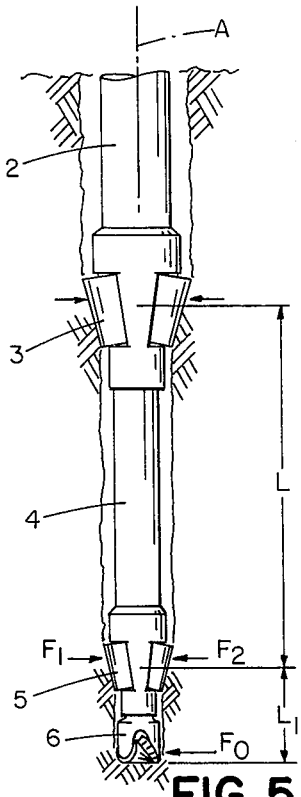
FIG 5
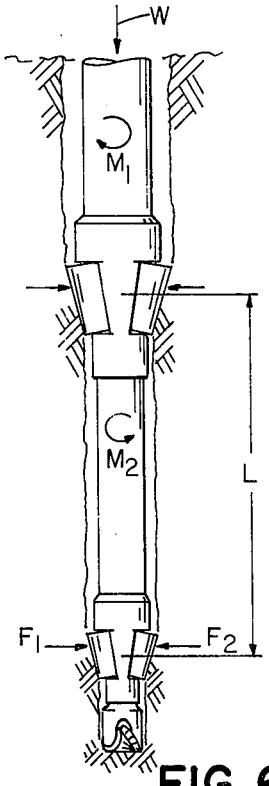
FIG 6

BORING APPARATUS CAPABLE OF BORING STRAIGHT HOLES

This invention relates to assemblies for drilling straight holes through rock, e.g. for the mining and oil well industries.

In mining it is desired to drill a hole downwardly to intersect a mine heading or tunnel. A very close tolerance is required of the order of 18 inches maximum lateral displacement or a deflection of no more than 10 or 15 minutes of arc for a hole that is 7 or 800 feet deep.

Subsequent to drilling the hole, a large boring head may be attached to the drilling string at the lower level, to be pulled upwardly to enlarge the hole, e.g. for forming an elevator shaft. In such cases the hole not only must be on target at the bottom to hit the mine heading, but it also must be straight along its length within close tolerances to avoid interference between the elevator and the walls of the shaft.

For oil wells a close tolerance, e.g. less than 1° total deflection, is desired in very deep drilling where a first depth of hole, e.g. 5000 feet, is to be lined with a steel casing cemented in place and the next depth, e.g. 12 to 20,000 feet, is then to be drilled with the drill pipe extending through the casing. The casing provides a volume which can be sealed from above in case the drill hits a gas pocket. If the casing is curved because the first depth has been drilled crookedly, the drill pipe will rub the inside of the casing for a long period during drilling to final depth. Such rubbing will wear a hole in the casing. If a high pressure gas pocket is hit during subsequent drilling to final depth, the gas pressure inside the casing will leak through the worn area and upward along the outside of the casing to the atmosphere, in a manner incapable of being shut off, resulting in loss of the valuable gas.

For these and other applications it is desired to provide a means for drilling holes with close tolerances of straighteness appropriate to the application and to do so at high drilling speeds, at low equipment cost and in a manner not requiring extreme skills.

Normal practice for straight hole drilling using roller bits has been to attempt to "fill" the hole for some distance above the bit with tightly fitting elements to stabilize the drill bit. Elements employed for this purpose have included roller stabilizers, bar stabilizers, and square drill collars. It is characteristic of these elements that they describe a cylindrical envelope upon rotation and do not enlarge the hole significantly from that produced by the pilot bit although in some instances such stabilizers may remove a slight quantity of rock from the hole walls. These elements in actuality have not been tight in the hole. An example will illustrate this point. Suppose it is wished to avoid curvature of the hole axis that would result in deviation of 10 minutes of angle after 100 feet of drilling. The radius of the curvature is 5730 feet. Now, the typical drilling element in a raise drilling operation in the mining industry is at most 5 feet long, as determined by constraints on machine dimensions. The departure from a straight line for this example of curvature is only 0.00436 inches in five feet. Clearly, no cylindrical device rotating in a rough-walled rock hole can be that tight—nor for that matter can any pilot bit, new or used, produce a hole of such closely held deviation in rock. In fact, then, the "tight" stabilization of conventional practice is simply not tight to the desired standard.

Other attempts to drill straight holes have involved use of less than normal downward drilling pressures, thus to cause less columnar deflection of the drill string, with the hoped-for result of less deflection of the bit and the hole.

Still another prior art disclosure has been of a conical stabilizer consisting of two or three stages of conical reamer to be placed in the drill string above the conventional pilot bit.

None of the foregoing proposals is an adequate teaching of a solution to straight hole drilling problems. It is the principle object of the invention to provide solutions to such problems and to provide a drilling assembly which can drill straight holes within close tolerances at reasonable cost, and with less trial and error than in the past.

According to the invention a rock boring assembly is provided for use in a drill string above a pilot boring bit of predetermined diameter smaller than the desired final hole size. The boring assembly comprises small and larger conical boring bits respectively mounted on lower and upper ends of an elongated spacer. The major effective cutting diameter of each of the conical boring bits is at least 10% greater than the minor effective cutting diameter of the respective bit. Also the spacer is provided with a cross section resistant to bending and effective to space the conical boring bits apart a distance at least 5 times the major cutting diameter of the smaller conical boring bit, to effectively locate the pivot points provided by the two conical boring bits at a distance from one another to limit bodily angular deflection of the assembly and to provide a substantial moment arm for resisting lateral forces applied to the assembly by the pilot bit and drill string. The spacer however spaces the conical bits a distance less than about 20 times the major cutting diameter of the lower conical boring bit, to enable the spacer to act as a bend-resistant beam to resist angular deflection of the axis of either of the conical borer bits relative to the other when the bit receives uneven lateral force due to non-uniformity of cutting conditions about the circumference of the bit.

In preferred embodiments each of the conical boring bits comprises a circular array of elongated roller cutting bits having axes extending along the axis of the drill string, the axis of each of the rollers is skewed relative to a plane passing through the axis of the drill string in a direction to provide axial self-advancing forces upon rotation of the drill string; and each roller is of frustoconical form with its small end directed downwardly, and the axis of each of the rollers in the upward direction is angled outwardly from the drill string axis.

These and other objects and features of the invention will be understood from the following description of a preferred embodiment taken in conjunction with the drawings wherein:

FIG. 1 illustrates diagrammatically a preferred embodiment of the boring assembly of the invention is use in forming a pilot hole for raise boring in the mining industry;

FIG. 2 is a view on an enlarged scale of the assembly of FIG. 1;

FIGS. 5 and 6 are diagrammatic views similar to FIG. 2, illustrating different off-centering forces and the reaction of the assembly to them.

Figure 3:
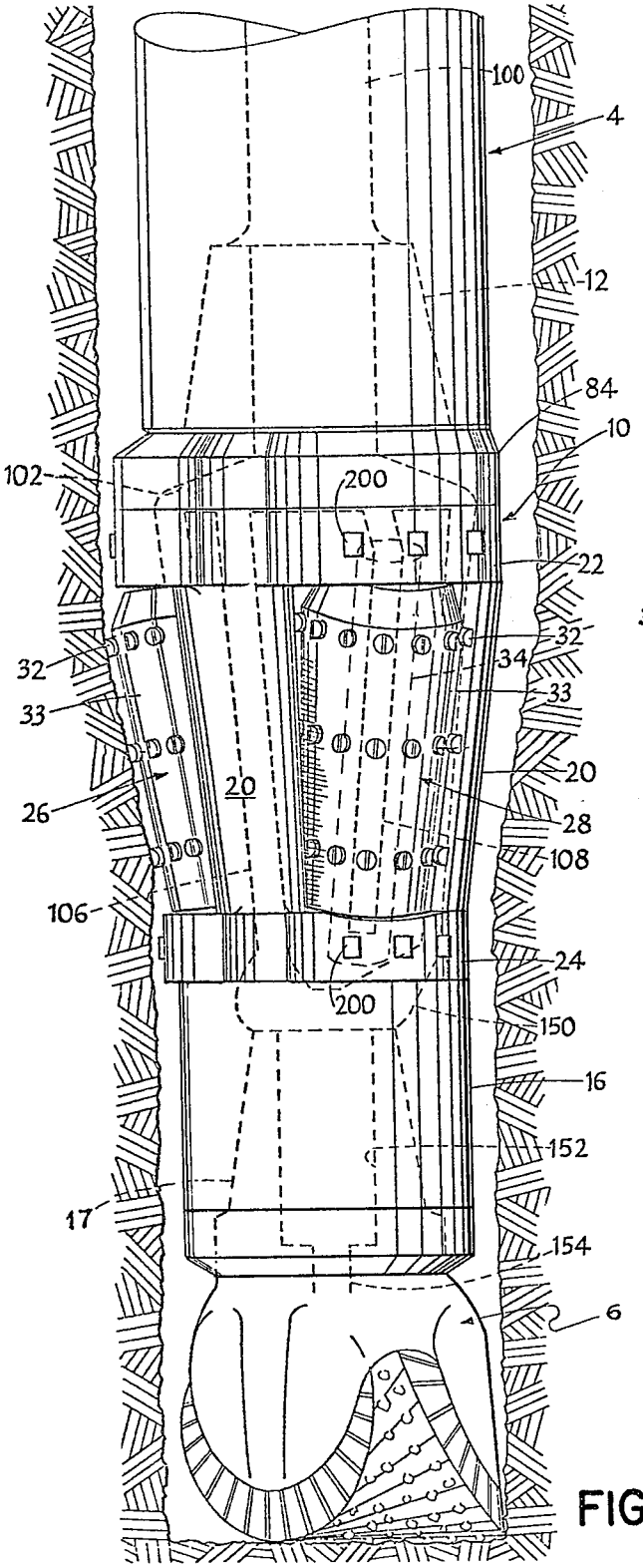
FIG. 3 is a side view on a still larger scale of the lower conical borer unit of FIG. 2.

Referring to FIGS. 1 and 2 a preferred straight hole drilling assembly is shown attached to the drill string 2 and consists of an upper conical borer or boring bit 3, a stiff spacer element 4, a lower conical borer 5, and a pilot bit 6. Lower conical borer 5 is sized to follow in the hole produced by pilot bit 6, for example 7⅞ feet diameter, and enlarge it significantly, for example to 9 ⅞ feet diameter. Upper conical borer 3 is sized to follow in the hole produced by lower conical borer 5 and enlarge it significantly, for example from 9 ⅞ inches to 12 ¼ inches diameter.

The two tightly stabilizing conical borers 3 and 5 fix the axis of the drilling assembly in a straight line. Spacer 4 is long and stiff to maximize the distance between the conical borers while avoiding bending between them. The proper length L is related to the maximum effective cutting diameter ($D_2$) of the lower bit. Excellent results have been attained with an L/D of about 8 while a range of L/D values from about 5 to 20 is operative.

In the preferred embodiment shown, lower conical borer 5 is attached immediately above pilot bit 6 although a spacer may be placed between these two elements. Similarly, additional spacers and additional larger conical borers might be attached above conical borer 3 or other devices may be employed in the drill string above conical borer 3 to limit deflection of the drill string, for example to prevent undue stress concentration at the point of connection of the drill string to conical borer 3.

The straight hole drilling assembly from upper conical borer 3 downward is extremely tightly held from lateral movement.

As shown the conical borer units of the preferred embodiment each comprises a frame carrying an array of freely rotatable roller cutters set to develop a frustoconical surface of revolution of extent sufficient to produce an upper diameter at least 10% greater than the lower diameter in the effective cutting region. These conical borer units are preferably of identical design except for the difference in scale to permit both upper and lower units to effect at least a 10% increase in hole size. Accordingly, only one of the conical borer units will be described in detail.

Figure 4:
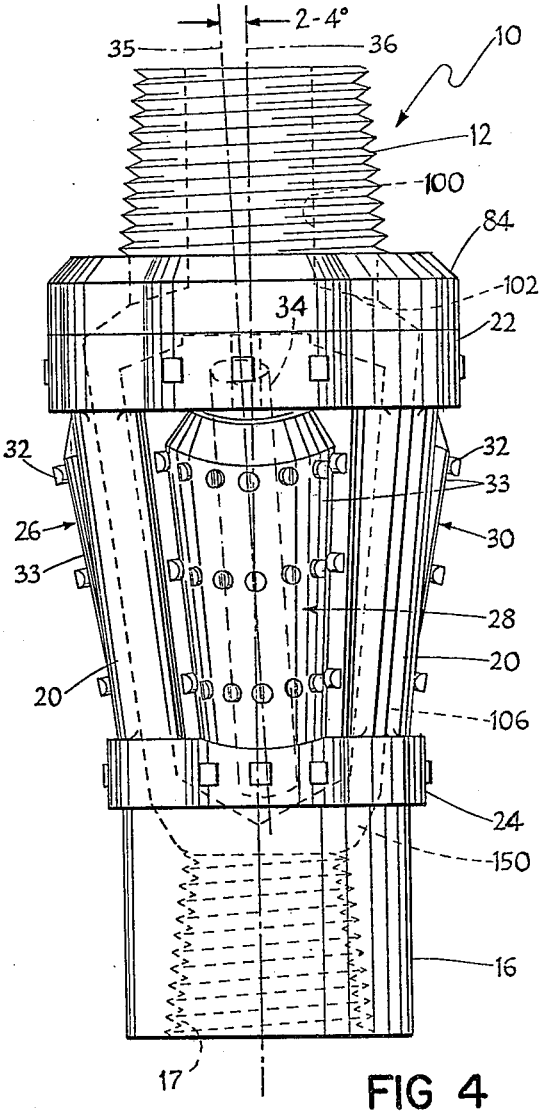
FIG. 4 is a view similar to that of FIG. 3, omitting the pilot bit and drill string, and turned so that one of the cutting rollers is directly centered in the view.

Referring to FIGS. 3 and 4 the lower conical borer consists of a main frame 10 connected at its top through externally threaded connector 12 to spacer 4, and at its bottom through internally threaded connector 16 to tricone pilot bit 6. Frame 10 tapers from top to bottom along three circumferentially spaced struts 20 extending between upper and lower frame portions 22 and 24. Three elongated roller cutters 26, 28, and 30 are respectively arranged between struts 20.

Each cutter has tooth inserts 32 in a body 33 mounted to rotate about shaft 34 having an axis 35 which not only generally follows the taper of struts 20 but is also skewed (e.g. up to 2°–4°, see FIG. 4) with respect to the vertical axis 36 of frame 10. In overall operation, rotation of frame 10 causes cutters 26, 28, and 30 to rotate and to enlarge the pilot hole produced by bit 6. The skew of the cutters produces vertical force components between the hole wall and the cutters, causing the apparatus to be at least partially self-advancing.

Provision is made for supplying flushing fluid (e.g. air, clear water, or mud, etc.) from the drill string 2 or spacer 4 attached to upper connection means 12 to the next lower element in the drill string (for example pilot bit 6 connected at lower connection means 17) and to cutters 26, 28, and 30 to flush the rock removed during the drilling process. Thus, axial fluid inlet passage 100 communicates with passage 108 in each shaft 34 and passage 106 in each strut 20. Passages 108 discharge flushing fluid around the base of each cutter, preferably in an upward direction, to flush rock cuttings from the conical cutting region. Passages 106 in struts 20 communicate through diagonal channels 150 to the lower connection means 17 to deliver flushing fluid to the next lower element in the drilling assembly.

There follows an explanation of how the assembly just described resists the various tendencies to drill crookedly, the explanation also concerning choice of the specific design details for particular drilling conditions.

FIG. 5 illustrates the likely condition of a tendency to deflect the drill assembly produced by a non-uniform rock encountered by the pilot bit 6. The pilot bit strikes harder rock at the right hand side of FIG. 5 than at the left, generating net lateral force $F_0$ tending to push the pilot bit 6 to the left and to rotate the axis A of the entire drill string clockwise. This tendency to rotate causes the lower conical borer 5 to begin to cut deeper on its left side than on its right with proportionate increase in reaction force, $F_1$, at the left and a proportionate decrease in reaction force, $F_2$, at the right, the net force from the left, $F_1 - F_2$ resisting rotation of the axis A of the assembly. Due to the amount of cutting performed by lower conical borer 5, forces are large, e.g. on the order of 10,000 pounds each, hence a small percentage change in these forces results in a large absolute force to counteract $F_0$, this being produced with a relatively small deflection of the conical borer to the left. Under these conditions the assembly tends to pivot about the upper conical borer 3, this pivoting being resisted by the drill string if sufficiently stabilized, or by a third conical borer spaced upwardly from borer 3.

In one extreme, if there is no resistance provided by the assembly beyond upper conical borer 3, the assembly will pivot around the upper conical borer 3. In that case it is desirable for the spacing L between upper and lower conical borers to be considerably long to minimize the angular deflection of the drill assembly that results from a given sideways deflection of its lower part. The more normal situation is that the drill string above upper conical borer 3 will have a considerable degree of stiffness. To ensure that the moments then produced do not cause bending between the upper and lower conical borers, their spacing L, while long, should be limited commensurate with the stiffness afforded by the moment of inertia of the cross-section of the spacer 4, limited by the diameter of the hole and the flow requirement of the drilling fluid. Also because the bending moment in the spacer from loading of pilot bit 6 is equal to $F_0 \times L_1$, $L_1$ being the distance from $F_0$ to the effective center of the lower conical borer, it is preferred that $L_1$ be minimized, that the lower conical borer be attached directly above the pilot bit and that lower conical borer be as short as possible from its effective center to its lower connection.

FIG. 6 illustrates another common cause for crooked hole drilling. The pilot bit requires a downward force or weight to penetrate the rock formation. This weight places the drill string in compression or at least the lower portion of it in the case of a very deep hole. The drill string is smaller than the hole it is in, hence, under this compressive load, the drill string tends to buckle and lie against a side of the hole and thus place a bending moment on the boring assembly at the bottom of the hole. As shown in FIG. 6 this moment $M_1$ tends to rotate the boring assembly about a pivot point provided by the upper conical borer and is counteracted by an equal and opposite bending moment $M_2$ arising from the cutting assemblies below the upper conical borer. Again moment $M_2$ arises from a lateral force unbalance, $F_1$ being larger than $F_2$ on the lower conical borer. And again the extended length L is favorable in these circumstances so that the bending moment $F_1 - F_2 \times L$ is large. The permissible length of L has an upper limit based on the cross-section because of considerations noted above in regard to FIG. 5, to avoid detrimental angular deflections between the axes of the upper and lower conical borers, and resultant progress of the lower conical borer in a direction at an angle to the desired hole axis. Thus again, there are both minimum and maximum limits on the spacing between the conical borer bits for achieving straightness within a selected narrow tolerance.

One of the benefits of the assembly here shown is that it results in the use of a pilot bit which, rather than being of the size of the desired final bore, as is conventional, is substantially smaller than the desired hole bore. Therefore less weight is required on the drill string and hence there is less tendency for the upper drill string to buckle. Furthermore, if it does so, and lies against one side of the hole, the axial force of the upper drill string remains less for the same reason, hence the moment $M_1$, to be counteracted, is reduced. For the same reason, referring back to FIG. 5, any side force on the pilot bit is reduced approximately to the same proportion that the pilot bit is reduced from the desired final hole size.

Figure 7A:
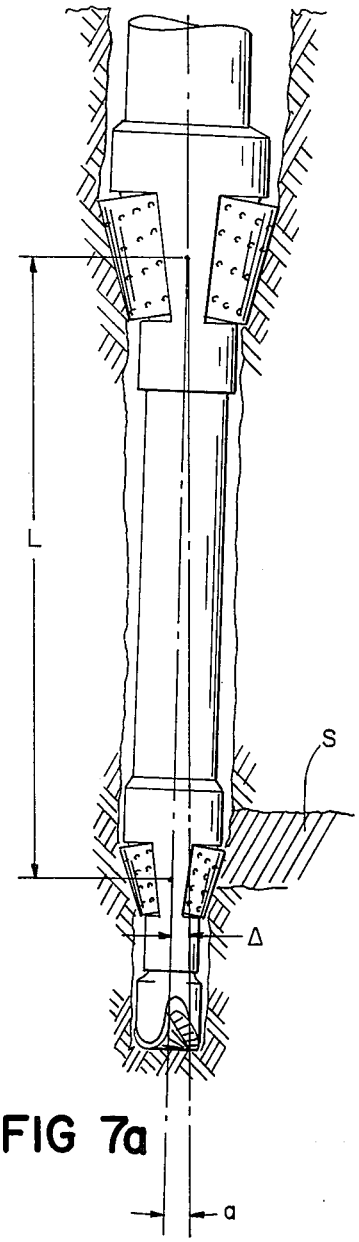
FIGS. 7*a*, 7*b* and 7*c* are diagrammatic views illustrating the self-righting effect of the assembly when it passes through a non-uniform rock condition.
Figure 7B:
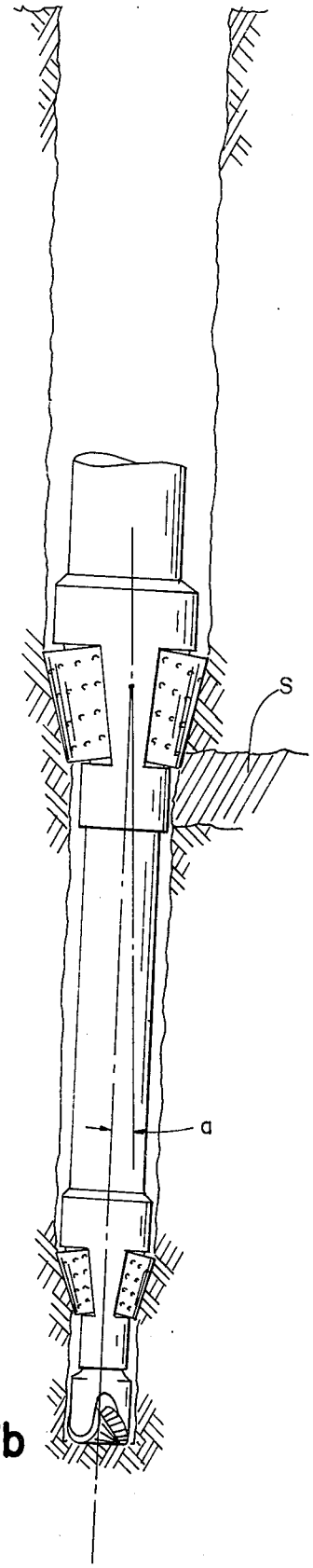
Figure 7C:
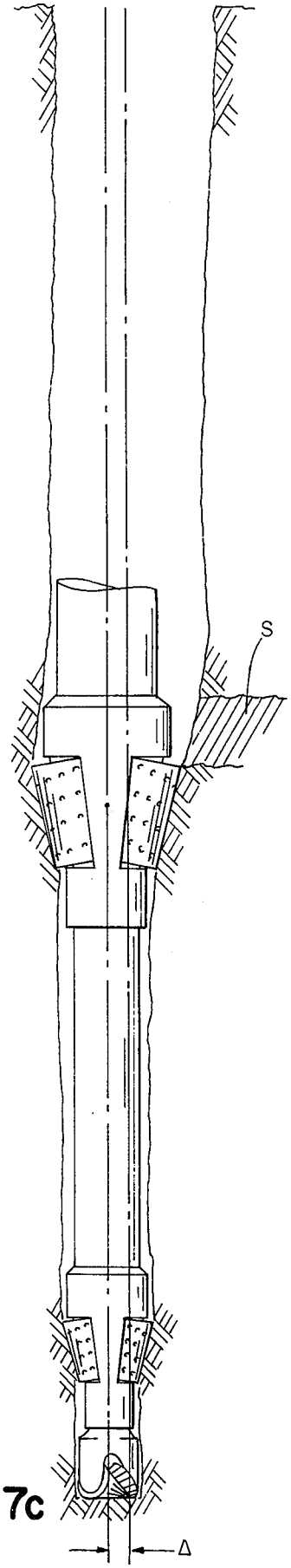

FIGS. 7*a*, 7*b* and 7*c* illustrate a self-correcting capability of the assembly where it encounters and is deflected sideways by a distinct hard spot during the course of drilling. (Deflection is both linearly and angularly exaggerated for purposes of illustration). In FIG. 7*a* a distinct hard spot S on one side of the lower conical borer causes deflection Δ as the conical borer passes. The assembly pivots about the upper conical borer as shown (for purposes of illustration the preferred upper drill string stabilizers are omitted so that there is no resistance to this pivoting provided by anything further above in the drill string, hence the effect is shown exaggerated). Having passed the hard spot from the position shown in FIG. 7*a* to the position shown in FIG. 7*b*, the drilling assembly follows a straight path at the angle *a* from the desired original path, the tangent of angle *a* being (Δ/L). As shown in FIG. 7*b* the second conical borer is commencing to encounter the same hard spot. As shown in FIG. 7*c* if the second conical borer cuts approximately the same increment of radius as the first borer, in passing the hard spot it will be deflected in the same direction by approximately the same amount Δ as was the first borer (FIG. 7*a*) so that the axis of the conical borer assembly returns to an orientation parallel to the original desired path, offset in an amount Δ . In practice Δ may be a small fraction of an inch. The new path, though offset, is thus parallel to the original path and the offset is not significant. In contrast, were the initial offset angle not corrected, and allowed to project over a long drilling length, it could result in an intolerable error.

With the foregoing considerations in mind, the distance between the first and second conical borers is established between about 5 and 20 diameters of the maximum cutting diameter of the first borer, the length selected depending upon the particular drilling conditions and specified hole deflection tolerances for the reasons noted. In the example given below with the L/D ratio of 8, the assembly was effective to bore a straight hole in hard rock within a deflection tolerance of 10 minutes arc.

The primary purpose for the requirement of a substantial cut of at least 10% increase in diameter by each of the conical borers is to ensure that the normal cutting forces balanced between the rollers in each conical borer are large forces (e.g. with 1000 pounds side force per inch of roller and with rollers 6, 8 or more inches in length for large hole size, the side force may be 10,000 pounds per roller, produced by reaction of the rock being drilled). Under these conditions a small change in the penetration per rotation of the conical borer results in a small percentage change in the forces on each roller but this small percentage applied to a large base force of 10,000 pounds results in a large corrective force for a very small lateral deflection of the conical borer.

The advantage of the preferred self-advancing feature, provided by skew of the rollers in the preferred embodiment, is that, as observed with a single conical borer following a pilot bit, the self-advancing feature literally locks the conical borer axially in the rock and drastically reduces or even eliminates the bouncing of the drilling assembly. This means that in the straight hole application the two conical borers with the self-advancing feature will each be locked axially so that the assembly does not bounce or become loose and free to shift laterally as drilling proceeds, so that both spaced reference points (i.e., the borers) defining the axis of the hole are firmly stabilized. The self-advancing feature is achieved by keeping the cone angle generated by the conical borer small, typically 11° half cone angle, and keeping the skew of the rollers relative to a plane projected through the axis of the drill string high enough so that the ratio of the side force due to the skewed arrangement of the roller relative to the side force necessary to penetrate the rock is as large as or larger than the tangent of the half cone angle. The tangent of 11° is about 0.2 and a 2° skew angle on a roller achieves self-advancing.

A specific preferred embodiment of the invention that has demonstrated straight hole drilling of less than 10 minutes of angle deflection consisted of a ⅞ inches diameter standard roller pilot bit. The first conical borer had a minor effective cutting diameter of 7 ⅞ inches and a major effective cutting diameter of 9 ⅞ inches, the steel pipe spacer 4 was 8 ¼ inches in outside diameter, 3 or 4 inches inside diameter and 61 inches long, with the effective spacing between the centers of the cutters on the two conical borers approximately 80 inches, and the upper conical borer had minor and major effective cutting diameters of 9 ⅞ inches and 12

¼ inches respectively Above this assembly a series of bar stabilizers were spaced along the drill string to prevent excessive bending loads on the connection of the drill string to the upper conical borer.

In general, forces in all directions from the rock upon the drilling structure vary depending upon the hardness of the rock, but all of them vary in proportion. That is, in generally soft rock the forces needed to penetrate the rock are relatively low as are those that arise from non-uniformities in the rock and the corrective forces that are needed to keep a straight line are proportionately low. However the stiffness or the ability of the assembly to resist deflection is independent of the rock properties. This means that a drilling assembly that deflects relatively little for the low forces involved in soft rock, and therefore is to be considered a stiff drilling assembly for such use, would deflect more in hard rock. This means that the length of spacer 4 should be less in hard rock than in soft.

For further details concerning a preferred construction of the conical boring bits reference is made to applicants' copending U.S. patent application Ser. No. 448,245 filed Mar. 5, 1974 entitled "Boring Apparatus, now Pat. No. 3,897,837, , issued Aug. 5, 1975, which is hereby incorporated by reference.

I claim:

1. A rock boring assembly for producing a straight hole for use in a drill string above a pilot boring bit of predetermined diameter smaller than the desired final hole size, said boring assembly comprising a small conical boring bit and a larger conical boring bit, said conical boring bits mounted of lower and upper ends of an elongated spacer, respectively, the major effective cutting diameter of each of said conical boring bits being at least 10% greater than the minor effective cutting diameter of the respective bit, said spacer having a cross-section resistant to bending under the expected cutting forces, said spacer being rigidly connected to said conical bits to rotate therewith while spacing said conical boring bits apart a distance at least five times the major cutting diameter of said small conical boring bit, thereby spacing the pivot provided by said two conical boring bits to limit bodily angular deflection of said assembly and providing a substantial moment arm to resist lateral forces applied to said assembly by said pilot bit and drill string, and said spacer spacing said conical bits a distance than about 20 times the major cutting diameter of said lower conical boring bit to enable said spacer to act as a bend-resistant beam to resist angular deflection of the axis of either of said conical boring bits relative to the other when it receives uneven lateral force due to non-uniformity of cutting conditions about the circumference of said bit, said spacer spacing said conical bits apart by from 4 to 16 feet.

2. The boring assembly of claim 1 wherein the upper and lower conical borers are proportioned to cut substantially the same size radical increment.

3. The boring assembly of claim 1 wherein each of said conical boring bits comprises a circular array of elongated roller cutting bits having axes extending along the axis of said drill string.

4. The boring assembly of claim 3 wherein the axis of each of said rollers is skewed relative to a plane passing through the axis of said drill string in a direction to provide axial self-advancing forces upon rotation of said drill string.

5. The boring assembly of claim 3 wherein each roller is of frusto-conical form with its small end directed downwardly, and the axis of each of said rollers in the upward direction angles outwardly from said drill string axis.

6. The boring assembly of claim 1 wherein the L/D ratio of the distance L between upper and lower conical boring bits and the maximum effective cutting diameter D of the lower conical boring bit is about 8.

7. The boring assembly of claim 6 wherein each of said conical boring bits comprises a frame mounting an array of three cutting rollers, said cutting rollers mounted at an angle relative to the hole axis so that upon rotation of said frame a come of about 22° included angle is generated, and said rollers being skewed relative to a plane projected through said hole axis at an angle between about 2° and 4° in direction to produce self-advancing forces of said assembly when said assembly is rotated.

* * * * *

UNITED STATES PATENT AND TRADEMARK OFFICE

CERTIFICATE OF CORRECTION

PATENT NO. : 4,031,974

DATED : June 28, 1977

INVENTOR(S) : Carl R. Peterson

It is certified that error appears in the above-identified patent and that said Letters Patent are hereby corrected as shown below:

Col. 1, line 14, "drilling string" should be --drill string--.

Col. 1, line 66, "any" should be underlined.

Col. 2, line 62, "invention is use" should be --invention in use--.

Col. 3, line 15, "7 7/8 feet" should be --7 7/8"--.

Col. 3, line 17, "9 7/8 feet" should be --9 7/8"--.

Col. 3, line 34, "above conical" should be --above upper conical--.

Col. 4, line 37, "$F_1$-$\underline{F}2$" should be --$F_1$-$F_2$--.

Col. 4, line 64, "requirement" should be --requirements--.

Col. 4, line 66, "$F_0$ x $\underline{L}1,1$" should be --$F_0$ x $L_1$, $L_1$--.

Col. 5, line 25, "deflections" should be --deflection--.

Col. 7, line 23, "'Boring Apparatus," missing close quote.

Col. 7, line 42, "pivot provided" should be --pivot points provided--.

UNITED STATES PATENT AND TRADEMARK OFFICE

CERTIFICATE OF CORRECTION

PATENT NO. : 4,031,974

DATED : June 28, 1977

INVENTOR(S) : Carl R. Peterson

It is certified that error appears in the above-identified patent and that said Letters Patent are hereby corrected as shown below:

Col. 8, line 3, "distance than" should be --distance less than--.

Col. 8, line 14, "radical" should be --radial--.

Col. 8, line 38, "come" should be --cone--.

Col. 8, line 41, "of" should be --on--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*